US005477201A

United States Patent [19]

Garnto et al.

[11] Patent Number: 5,477,201

[45] Date of Patent: Dec. 19, 1995

[54] SINGLE SOLENOID ACTUATOR FOR TWO POLE GROUND FAULT CIRCUIT INTERRUPTER

[75] Inventors: Charles D. Garnto, Tucker; Stephen D. Cella, Stone Mountain; Harold L. Taylor, Norcross, all of Ga.

[73] Assignee: Siemens Energy & Automation, Inc., Alpharetta, Ga.

[21] Appl. No.: 195,635

[22] Filed: Feb. 14, 1994

[51] Int. Cl.[6] ..... H01H 73/00

[52] U.S. Cl. ..... 335/18; 335/202; 361/42

[58] Field of Search ..... 335/18, 132–133, 335/202; 361/42–50

[56] References Cited

U.S. PATENT DOCUMENTS 3,767,871 10/1973 Strobel ..... 335/10

4,342,974 8/1982 Nakano et al. ..... 335/35

4,442,470 4/1984 Misencik ..... 335/18

4,641,217 2/1987 Morris et al. ..... 335/18

5,260,676 11/1993 Patel et al. ..... 335/132

*Primary Examiner*—Lincoln Donovan

[57] ABSTRACT

A circuit breaker has a pair of poles, either of which can experience a ground fault. A sensing device senses an imbalance of current between the phases and neutral, and a trip device responsive to the sensing device simultaneously trips both of the poles when an imbalance of current (ground fault) is sensed in either of the poles. The trip device includes a trip lever engageable with each of the poles and a single solenoid for controlling operation of the trip lever.

5 Claims, 3 Drawing Sheets

SINGLE SOLENOID ACTUATOR FOR TWO POLE GROUND FAULT CIRCUIT INTERRUPTER

BACKGROUND OF THE INVENTION

CROSS-REFERENCE TO RELATED APPLICATIONS

This application is related to the following copending applications:

| | |
|---|---|
| Applicants | Charles D. Garnto and Stephen D. Cella; |
| Ser. No. | 08/195634 |
| Filed | February 14, 1994 |
| For | Electronic Housing for Two-Pole Ground Fault Circuit Interrupter |
| Applicants | Harold Louis Taylor and Elton C. Johnson |
| Ser. No. | 08/189,217 |
| Filed | January 31, 1994 |
| For | Electromagnetic and Radio Frequency Interference Suppression for Ground Fault Circuit Interrupters |
| Applicants | Harold Louis Taylor and Jerry M. Green |
| Ser. No. | 08/189,535 |
| Filing Date | January 31, 1994 |
| For | Power Supply For Ground Fault Circuit Interrupter |

FIELD OF THE INVENTION

This invention relates to circuit breakers and, more particularly, to a novel and highly effective circuit breaker that is considerably less expensive than conventional circuit breakers of the same class.

DESCRIPTION OF THE PRIOR ART

A two-pole circuit breaker conventionally has a pair of solenoids, one for each pole. If a ground fault is detected associated with either pole, the solenoid associated with that circuit breaker trips that pole. When the mechanism of the tripping pole comes in contact with the trip lever, the other pole is tripped. There is unavoidably a delay between the tripping of the two poles, since the contacts of the tripping pole will already be open when the tripping of the second pole is initiated.

Thus the arcing associated with the tripping of the circuit breaker is prolonged; first there is arcing associated with the tripping of the pole where the ground fault is detected, and then there is arcing associated with the tripping of the other pole.

What is more significant, the operation of the circuit breaker is slowed, since the protected circuit is not safe until both poles have been opened. When an electrical charge in a protected circuit flows through the body of a person in contact with it, it is important that the circuit breaker trip very quickly; the longer the charge flows through the body, the greater becomes the danger that the person's heart will begin to fibrillate, often with fatal consequences.

In addition, circuit breakers may incorporate electronic units to control their operation. These electronic units are susceptible to damage by heat. During thermal calibration of the circuit breaker, the sensitive electronic components may be subjected to thermal stresses.

Moreover, the solenoid is one of the most costly components in a ground fault circuit breaker. It is also susceptible to damage during assembly because of the fine wires that make up the solenoid coil.

OBJECTS AND SUMMARY OF THE INVENTION

An object of the invention is to remedy the problems of the prior art outlined above. In particular, an object of the invention is to provide an actuator for a two-pole ground fault circuit breaker that opens the contacts associated with both poles more quickly than a conventional circuit breaker in response to detection of a ground fault associated with either of the poles. Another object of the invention is to provide an actuator for a ground fault circuit breaker that is less expensive to manufacture than conventional actuators. Another object of the invention is to provide a better method of assembling a circuit breaker.

The foregoing an other objections are attained in accordance with the invention by the provision of a circuit breaker comprising a pair of poles, either of which can experience a ground fault; a sensing device for sensing excess current in either of the poles; and a trip device responsive to the sensing device for simultaneously tripping both of the poles when excess current is sensed in either of the poles.

Preferably, the trip device comprises a single trip lever engageable with each of the poles and a single solenoid for controlling operation of the trip lever.

In accordance with an independent aspect of the invention, there is provided a method of assembling a circuit breaker comprising the steps of mounting a solenoid for tripping the circuit breaker; effecting thermal calibration of the circuit breaker; and thereafter installing an electronics module for control of the solenoid; thereby facilitating verification of mechanical operation prior to completion of more costly electronics assembly steps.

BRIEF DESCRIPTION OF THE DRAWING

A better understanding of the objects, features and advantages of the invention can be gained from a consideration of the following detailed description of the preferred embodiments thereof, wherein.

DESCRIPTION OF THE PREFERRED EMBODIMENTS

Figure 1:
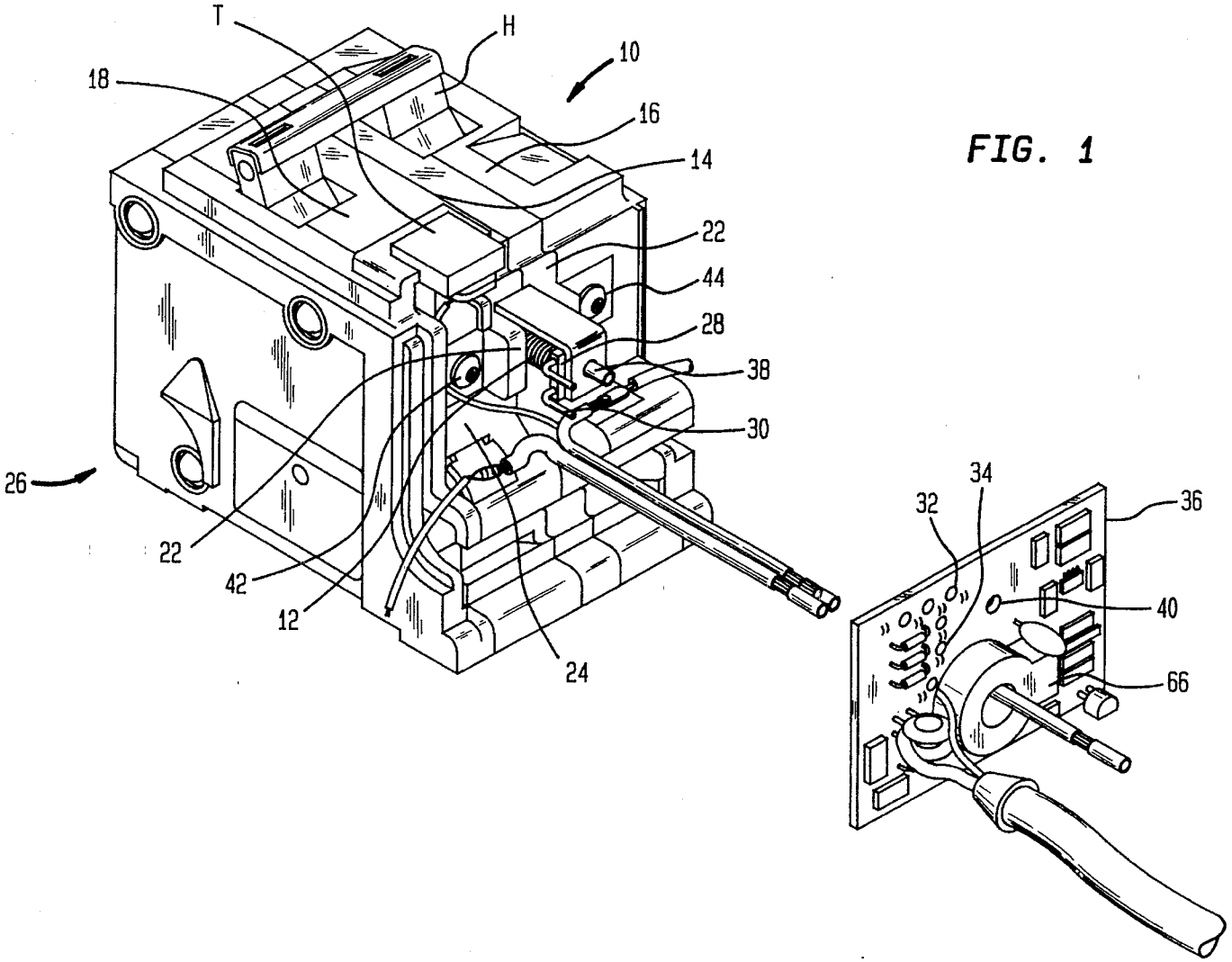
FIG. 1 is an exploded perspective view of a circuit breaker constructed in accordance with the invention.

Fig. 1 shows a circuit breaker 10 constructed in accordance with the invention. A solenoid 12 is mounted in position on a centerline 14 between two breaker poles 16, 18. It is held in position by walls 20, 22 projecting from a wall 24 of a housing 26. Leads 28, 30 of the solenoid 12 are aligned with terminals 32, 34, respectively on a circuit board 36.

The solenoid plunger 38 extends through a hole 40 in the circuit board 36.

Thermal calibration screws 42, 44 are employed for calibration before the circuit board 36 is installed.

Figure 2:
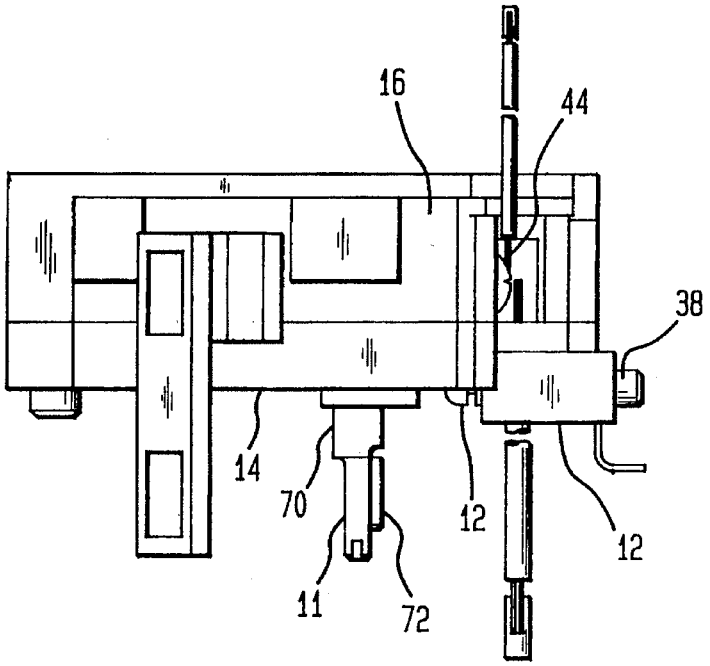
FIG. 2 is a top plan view of a portion of the structure of FIG. 1.
Figure 3:
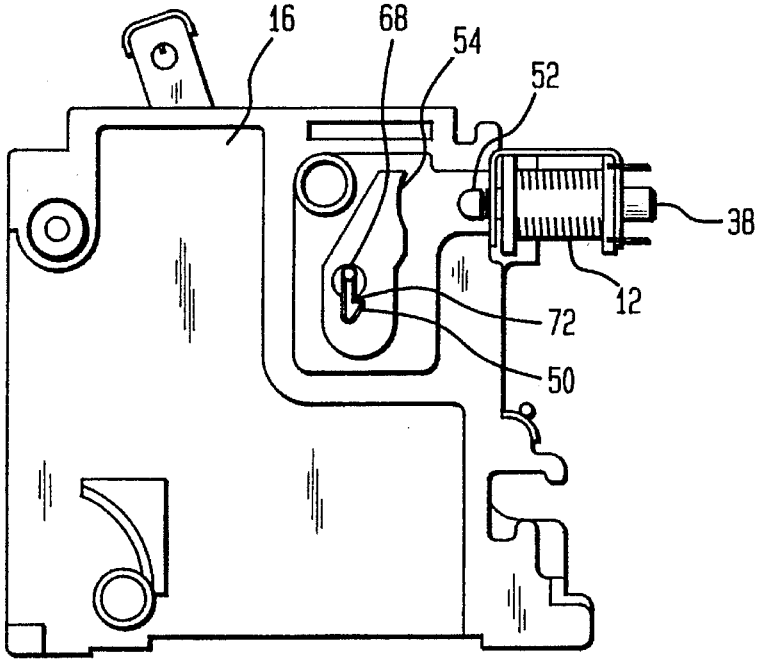
FIG. 3 is a side elevational view of the structure of FIG. 2.
Figure 4:
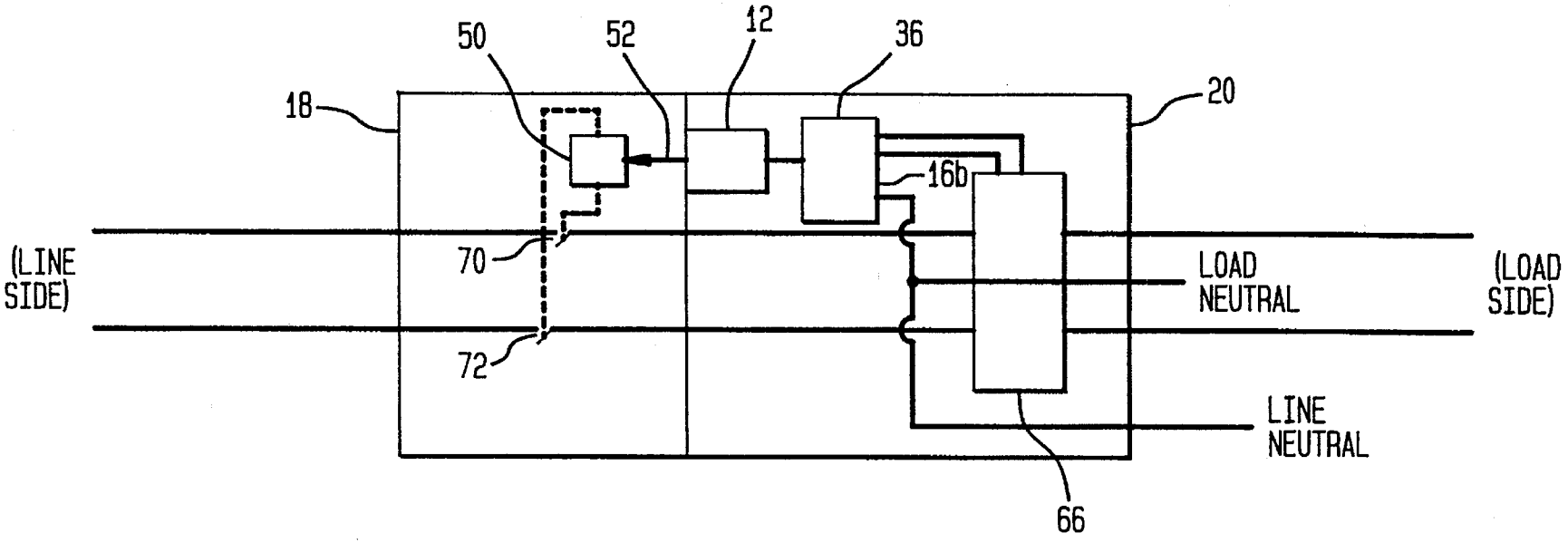
FIG. 4 is a schematic diagram of a electrical circuitry in accordance with the invention.

FIGS. 2 and 3 are respectively a top view and a side view of the breaker pole 16 and solenoid 12.

In accordance with the invention, a single trip lever 50 cooperates with a single solenoid 12. The plunger tip 52 of the solenoid 12 is adapted to engage a bearing surface 54 of the trip lever 50 which is common to both poles 16, 18.

The circuit breaker 10 thus comprises a pair of A and B phase poles 6, 18, either of which can experience a ground fault and a sensing device 66 for sensing an imbalance of current between the phases and neutral. A trip lever 50 is responsive to the sensing device 66 for simultaneously tripping both of the poles an imbalance of current is sensed in either of the poles.

The trip lever 50 comprises a pivot 68, arms 70 extending from the pivot 68 in opposite directions from the centerline 14 of the circuit breaker, and a pair of feet 72 respectively appended to the arms and respectively engageable with the poles. A mirror image of the arm 70 and foot 72 visible in FIG. 2 is in effect "reflected" at the centerline 14 and is hidden in FIG. 2. The lever 50 includes the central bearing surface 54, and the solenoid plunger 52 is engageable with the central bearing surface 54 for rotating the trip lever 50 about the pivot 68 and bringing the feet 72 into contact with the respective poles to trip both poles simultaneously, regardless of which pole experienced the ground fault. This avoids the problem of dual solenoid devices which rely on the pole where the ground fault occurred to trip the other pole when the mechanism of the tripping pole comes into contact with the trip lever. That is, the present invention avoids the delay between the tripping of the two poles that results when conventional two-solenoid devices are employed.

The solenoid is mounted directly on the breaker poles, the position of the solenoid being controlled by features in the molded housing which accurately locate the solenoid and trip lever.

The solenoid can be attached prior to installation of the circuit board so that thermal calibration of the breaker can be made without working around the circuit board. This allows the acceptability of the complete mechanical package to be verified prior to completion of the more costly electronics assembly steps. This also ensures that there is no binding in the mechanism, trip lever or solenoid when the production department unites the circuit breaker with the electronics module.

The trip lever 50 simultaneously trips two single pole breakers by moving the feet 72 into the breaker latch, thus tripping the breaker and opening its contacts, in response to detection of a ground fault in either pole of the circuit breaker. The trip lever 50 opens contacts in both poles of the breaker, by rotating the feet 72 into a position which disengages the latch of each breaker pole, in response to detection of a ground fault in either pole of the circuit breaker.

Solenoids are among the most costly components of a ground fault circuit interrupter. Solenoids are also susceptible to damage during assembly because of the fine wires that constitute the coil. Eliminating one of the solenoids reduces the overall cost of the unit by a substantial amount.

A conventional test button T and reset handle H are provided, as those skilled in the art will readily understand. Other features disclosed in the drawings but not essential to an understanding of the present invention are described in greater detail in the copending related applications listed above.

Thus there is provided in accordance with the invention a novel and highly effective circuit breaker that attains the objects of the invention set out above.

Many modifications of the preferred embodiment of the invention disclosed above will readily occur to those skilled in the art. For example, the method of mounting the solenoid and the physical appearance of the trip lever can both be varied, as those skilled in the art will readily understand. Accordingly, the invention is to be construed as including all subject matter that falls within the scope of the appended claims, and equivalents thereof.

We claim:

1. A circuit breaker comprising:

a pair of poles, either of which can experience a ground fault;

a neutral line;

a sensing device for sensing an imbalance of current between either of said poles and said neutral line; and a trip device oriented between said poles responsive to said sensing device for directly and simultaneously tripping both of said poles when an imbalance of current is sensed in either of said poles.

2. A circuit breaker according to claim 1 wherein said trip device comprises:

a trip lever engageable with each of said poles and a single winding solenoid for controlling operation of said trip lever.

3. A circuit breaker according to claim 2 wherein said trip lever comprises:

a pivot;

arms extending from said pivot in opposite directions from a centerline of said circuit breaker;

a pair of feet respectively appended to said arms and respectively engageable with said poles; and structure defining a central bearing surface;

said solenoid comprising a plunger engageable with said central bearing surface for rotating said trip lever about said pivot and bringing said feet into contact with said respective poles.

4. A circuit breaker comprising:

a pair of poles, either of which can experience a ground fault;

a neutral line;

a sensing device for sensing an imbalance of current between either of said poles and said neutral line; and a trip device oriented between said poles responsive to said sensing device for simultaneously tripping both of said poles when an imbalance of current is sensed in either of said poles;

wherein said trip device comprises:

a trip lever engageable with each of said poles and a single winding solenoid for controlling operation of said trip lever; and wherein said trip lever comprises:

a pivot;

arms extending from said pivot in opposite directions from a centerline of said circuit breaker;

a pair of feet respectively appended to said arms and respectively engageable with said poles; and structure defining a central bearing surface;

said solenoid comprising:

a plunger engageable with said central bearing surface for rotating said trip lever about said pivot and bringing said feet into contact with said respective poles to trip them simultaneously.

5. A method of assembling a circuit breaker comprising the steps of:

mounting on a housing of the circuit breaker a solenoid for tripping the circuit breaker;

effecting thermal calibration of circuit breaker components located in the housing; and thereafter installing an electronics module for control of the solenoid externally of the housing;

thereby facilitating verification of mechanical operation of circuit breaker components prior to completion of more costly electronics assembly steps.

* * * * *